US009133853B2

(12) United States Patent
Davis et al.

(10) Patent No.: US 9,133,853 B2
(45) Date of Patent: Sep. 15, 2015

(54) PUMP DESIGNED FOR INSTALLATION CONVERSION

(75) Inventors: Mark Alan Davis, Seneca Falls, NY (US); Timothy Martin Falkiewicz, Auburn, NY (US); Mark Alexander Playford, Seneca Falls, NY (US)

(73) Assignee: ITT MANUFACTURING ENTERPRISES LLC.

( * ) Notice: Subject to any disclaimer, the term of this patent is extended or adjusted under 35 U.S.C. 154(b) by 1051 days.

(21) Appl. No.: 13/187,766

(22) Filed: Jul. 21, 2011

(65) Prior Publication Data

US 2012/0051905 A1 Mar. 1, 2012

Related U.S. Application Data

(60) Provisional application No. 61/366,309, filed on Jul. 21, 2010.

(51) Int. Cl.

| | |
|---|---|
| ***F04D 29/05*** | (2006.01) |
| ***F04D 29/046*** | (2006.01) |
| ***F04D 7/04*** | (2006.01) |
| ***F04D 29/62*** | (2006.01) |

(52) U.S. Cl.

CPC ..... *F04D 29/0462* (2013.01); *F04D 7/045* (2013.01); *F04D 29/628* (2013.01)

(58) Field of Classification Search

CPC ..... F04D 7/02; F04D 7/045; F04D 29/05; F04D 29/0462; F04D 29/0563; F04D 29/056

USPC ..... 415/213.1, 229, 214.1, 203

See application file for complete search history.

(56) References Cited

U.S. PATENT DOCUMENTS

| | | | |
|---|---|---|---|
| 1,604,419 | A | 10/1926 | Oliphant |
| 1,696,635 | A | 12/1928 | Jennings |
| 2,945,448 | A | 2/1957 | Frederick |
| 3,435,778 | A | 4/1969 | Ascuitto et al. |
| 3,841,791 | A | 10/1974 | Doolin |
| 4,060,341 | A | 11/1977 | Tremain et al. |

(Continued)

FOREIGN PATENT DOCUMENTS

| | | |
|---|---|---|
| CN | 201347899 | 11/2009 |
| EP | 1318361 | 6/2003 |

(Continued)

OTHER PUBLICATIONS

CN201347899 English Language Abstract (1 pg).

*Primary Examiner* — Edward Look
*Assistant Examiner* — Maxime Adjagbe

(57) ABSTRACT

Apparatus is provided featuring a bearing cartridge in combination with a pedestal. The bearing cartridge may be configured to be coupled to a pumping assembly combination and having a predetermined centerline. The pedestal may be configured with an axial channel to receive and support the bearing cartridge and allow the bearing cartridge to slide therein. The bearing cartridge and the pedestal are configured to couple together substantially at or above the centerline of the bearing cartridge in order to reduce center height requirements of the apparatus, where the center height is defined as the distance between the centerline of the bearing cartridge and the bottom surface of the pedestal supporting the bearing cartridge. The apparatus takes the form of a pump or pumping assembly, arrangement or combination, including a slurry-type pump or a centrifugal pump.

19 Claims, 5 Drawing Sheets

(56) References Cited

U.S. PATENT DOCUMENTS

| | | | | |
|---|---|---|---|---|
| 4,521,151 | A | 6/1985 | Frater et al. | |
| 5,344,291 | A | 9/1994 | Antkowiak | |
| 5,439,180 | A | 8/1995 | Baughman et al. | |
| 5,549,461 | A | 8/1996 | Newland | |
| 5,868,550 | A | 2/1999 | Howchin | |
| 5,906,479 | A | 5/1999 | Hawes | |
| 6,398,521 | B1 | 6/2002 | Yorulmazoglu | |
| 6,490,986 | B1 | 12/2002 | Sherdel | |
| 6,817,194 | B1 | 11/2004 | Leach | |
| 7,074,017 | B2 | 7/2006 | Coray et al. | |
| 7,156,625 | B2 | 1/2007 | Grant | |
| 2006/0051198 | A1* | 3/2006 | Torres-Reyes | 415/111 |
| 2006/0078444 | A1 | 4/2006 | Sacher | |
| 2006/0275153 | A1 | 12/2006 | Lisi et al. | |
| 2009/0301705 | A1 | 12/2009 | McCreedy et al. | |
| 2010/0064705 | A1 | 3/2010 | Chauvin et al. | |
| 2010/0089086 | A1 | 4/2010 | Badia et al. | |

FOREIGN PATENT DOCUMENTS

| | | |
|---|---|---|
| EP | 1634612 | 3/2006 |
| GB | 309571 | 3/1930 |
| WO | 0058630 | 10/2000 |
| WO | 2009052398 | 4/2009 |
| WO | 2009144452 | 12/2009 |
| WO | 2009149511 | 12/2009 |

* cited by examiner

PUMP DESIGNED FOR INSTALLATION CONVERSION

CROSS REFERENCE TO RELATED PATENT APPLICATION

This application claims benefit to patent application Ser. No. 61/366,309, filed 21 Jul. 2010, which is hereby incorporated by reference in its entirety.

BACKGROUND OF THE INVENTION

1. Field of the Invention

The present invention relates to a pump or pumping assembly, arrangement or combination; and more particularly relates to a pump or pumping assembly, arrangement or combination designed for installation conversion, e.g., for a centrifugal pump, a slurry-type pump, as well as other types or kinds of rotary equipment such as fans or compressors.

2. Brief Description of Related Art

When pumps get old and/or worn out, they need to be replaced. However, when an older pump is replaced with a newer pump, issues can arise in relation to an installation conversion. For example, known pump designs have a wide variety of center heights, bolt patterns, and drive configurations, many times making it difficult to interchange the pump, e.g., without removing concrete foundations. This is typically expensive and can lead to significant delays in the pump replacement process.

By way of example, FIGS. 1*a*, 1*b*, 1*c* show prior art pump designs.

FIG. 1*a* shows a known pedestal design generally indicated as 10 having an adjusting bolt arrangement generally indicated by an arrow 12 arranged in a base 13 under a bearing cartridge generally indicated as 14 having a power transmitting shaft 17 arranged therein, the bolt arrangement 12 configured for adjusting the relationship between the bearing cartridge 14 and a pump shell 18 having an impeller (not shown) arranged therein.

FIG. 1*b* shows another known pump design generally indicated as 20 also having its adjusting screw 22 arranged in a base 23 under a bearing cartridge generally indicated by arrow 24 having a power transmitting shaft 27 arranged therein, the adjusting screw 22 configured for adjusting, e.g., the clearance of an impeller 26 coupled to the shaft 27 arranged in a pump shell 28.

FIG. 1*c* shows still another known design generally indicated as 30 also having its adjusting screw arrangement generally indicated by arrow 32 arranged in a base 33 underneath a bearing assembly generally indicated by arrow 34 having a power transmitting shaft 37 coupled to an impeller 36 arranged therein, the adjusting screw arrangement 32 configured for adjusting the relationship between the bearing cartridge 34, impeller 36 and a pump shell 38.

One problem with these known pump designs in FIGS. 1*a*, 1*b* and 1*c* is that each requires increasing the center height (CH) (see FIG. 1*a*) to allow someone to gain access to the adjusting screw when the pump is assembled, where the center height (CH) is defined as the distance between the axis or centerline (CL) of the bearing cartridge and the bottom of the base supporting the bearing cartridge. The increased center height (CH) of these known pumps can become a significant limiting factor during pump installation conversion, especially in cases where the pump being replaced has one center height and is situated on a concrete foundation that has a predetermined height of its own. These combined heights will affect the center height of the replacement pumps that can be used in the installation conversion and determine whether the replacement of the pump can be made without removing concrete foundations.

In view of this, there is a long felt need in the industry for an improved pump design or technique that solves the problems related to installation conversion when pumps need to be replaced.

SUMMARY OF THE INVENTION

To overcome the aforementioned problems, a new technique has been developed that takes the form of apparatus featuring a bearing cartridge in combination with a pedestal. The bearing cartridge may be configured to be coupled to a pumping assembly combination and having a predetermined centerline. The pedestal may be configured with an axial channel to receive and support the bearing cartridge and allow the bearing cartridge to slide therein. The bearing cartridge and the pedestal are configured to couple together substantially at or above the centerline of the bearing cartridge in order to reduce center height requirements of the apparatus, where the center height is defined as the distance between the centerline of the bearing cartridge and the bottom surface of the pedestal supporting the bearing cartridge. The apparatus takes the form of a pump or pumping assembly, arrangement or combination, including a slurry-type pump or a centrifugal pump.

According to some embodiments, and provided by way of example, the apparatus may also include one or more of the following features:

1) The bearing cartridge and the pedestal are configured to couple together by an adjustable mounting assembly.

2) The adjustable mounting assembly may include, e.g., at least one mounting member coupled to the pedestal; at least one corresponding mounting member coupled to the bearing cartridge; and an arrangement of threaded bolts or rods and nuts configured to couple the at least one mounting member of the pedestal and at least one corresponding mounting member of the bearing cartridge so as to slide the bearing cartridge in relation to the pedestal when one or more of the nuts is turned.

3) The apparatus may also include a base adapter configured to be arranged between the pedestal and a pre-existing supporting foundation and to support the pedestal on the pre-existing supporting foundation.

One advantage of the new design or technique is that it offers users the ability to completely replace an existing pump without disturbing the original foundation or suction/discharge piping (depending on user preference). The user can then benefit from improvements in a bearing cartridge or assembly design as well as improvements in wet end design with very little installation effort.

An additional advantage is afforded to the manufacturer as a pump with a low center height and corresponding foundation cannot be replaced by competitors, requiring new foundations and dissuading customers from replacing the piece of equipment.

In effect, the new design or technique consists of a pump with a wet end and a powerframe (also called a bearing frame or power end). The powerframe has a center to base height very near the minimum achievable with current materials technology, significantly less than current offerings. This allows for cast, fabricated, or machined spacers to be put between the powerframe of the new pump and the existing foundation to allow the adjustment of the new pump's center height and position relative to drive elements (motor and gearbox shafts) and suction or discharge piping. Different spacers can be provided to allow a single model of pump to be adapted to multiple models of competitor equipment.

This reduction in center height is achieved by a number of new, unique design features:

- Bearing cartridge lubricant sump designed to allow optimal lubrication oil volume while decreasing centerline height.
- Wet end (casing, impeller, and gland components) attached to bearing pedestal solely by members at or near centerline. Traditional designs connect wet end to bearing pedestal using at least one member below the centerline.
- Design of pedestal and bearing cartridge that moves sliding interface between bearing cartridge and pedestal substantially at or above centerline of bearing cartridge. This allows a greater mass of material to be incorporated in the pedestal to add strength and absorb vibration while still maintaining a low center height. There are many slurry pump manufacturers and almost all make conversion kits for competitor pumps, but none are known to have specifically designed a complete pump for use in converting competitor installations. The typical approach is to produce a wet end conversion kit, which substitutes only the wetted wear parts of the original pump for a competitor's and leaves the existing bearing frame & support pedestal intact. This design or technique replaces the entire pump, giving the end user the benefit of bearing frame and pedestal improvements as well as wetted wear part improvements. This design or technique specifically targets complete pump replacements, in accordance with the disclosure provided herein.

According to some embodiments of the present invention, the apparatus may comprise bearing cartridge means for coupling to a shaft of a motor and having a predetermined centerline; pedestal means for receiving and supporting the bearing cartridge and allowing the bearing cartridge to slide within an axial channel; and means for coupling together the bearing cartridge means and the pedestal means substantially at or above the centerline of the bearing cartridge in order to reduce center height requirements of the apparatus, consistent with that disclosed herein.

BRIEF DESCRIPTION OF THE DRAWING

The drawing includes the following Figures, not necessarily drawn to scale.

In the following description of the exemplary embodiment, reference is made to the accompanying drawings, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

Figure 1A:
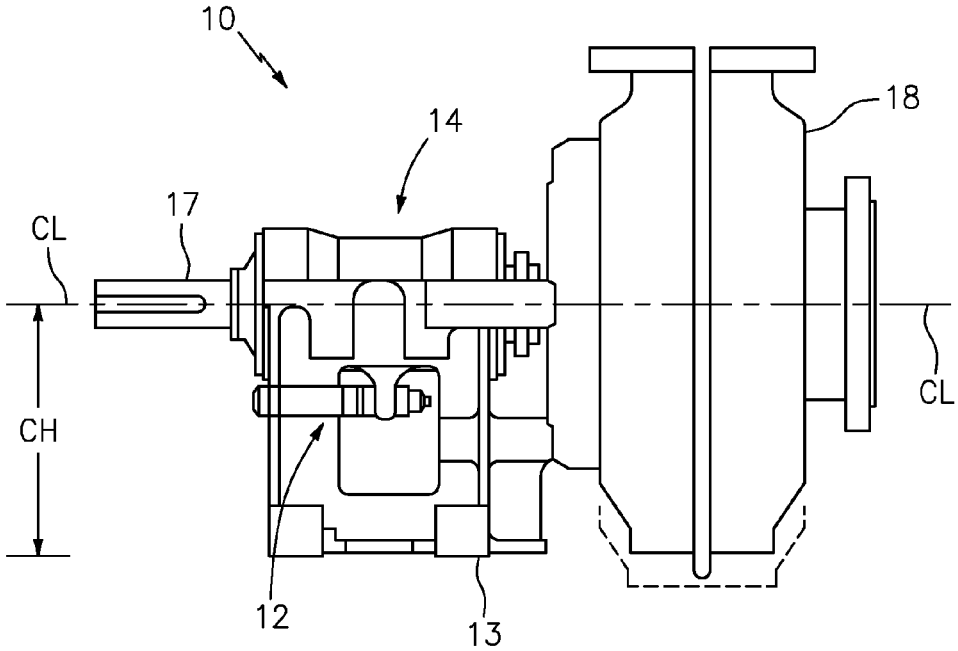
FIG. 1*a* shows a side view of a pump that is known in the art.
Figure 1B:
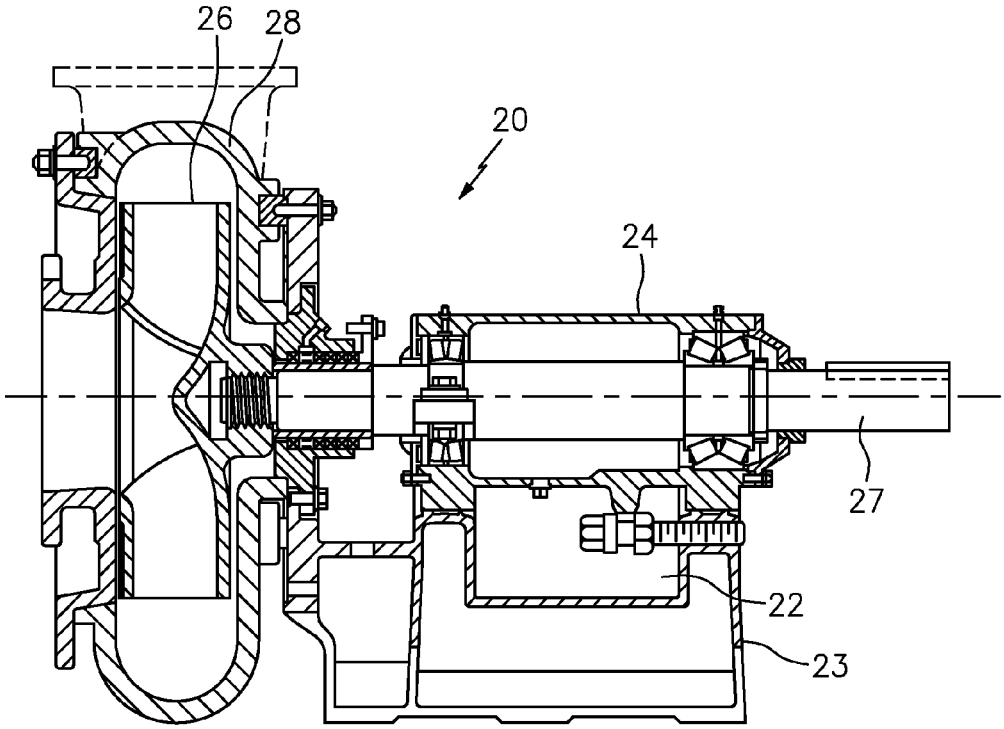
FIG. 1*b* shows a side cross-sectional view of another pump that is known in the art.
Figure 1C:
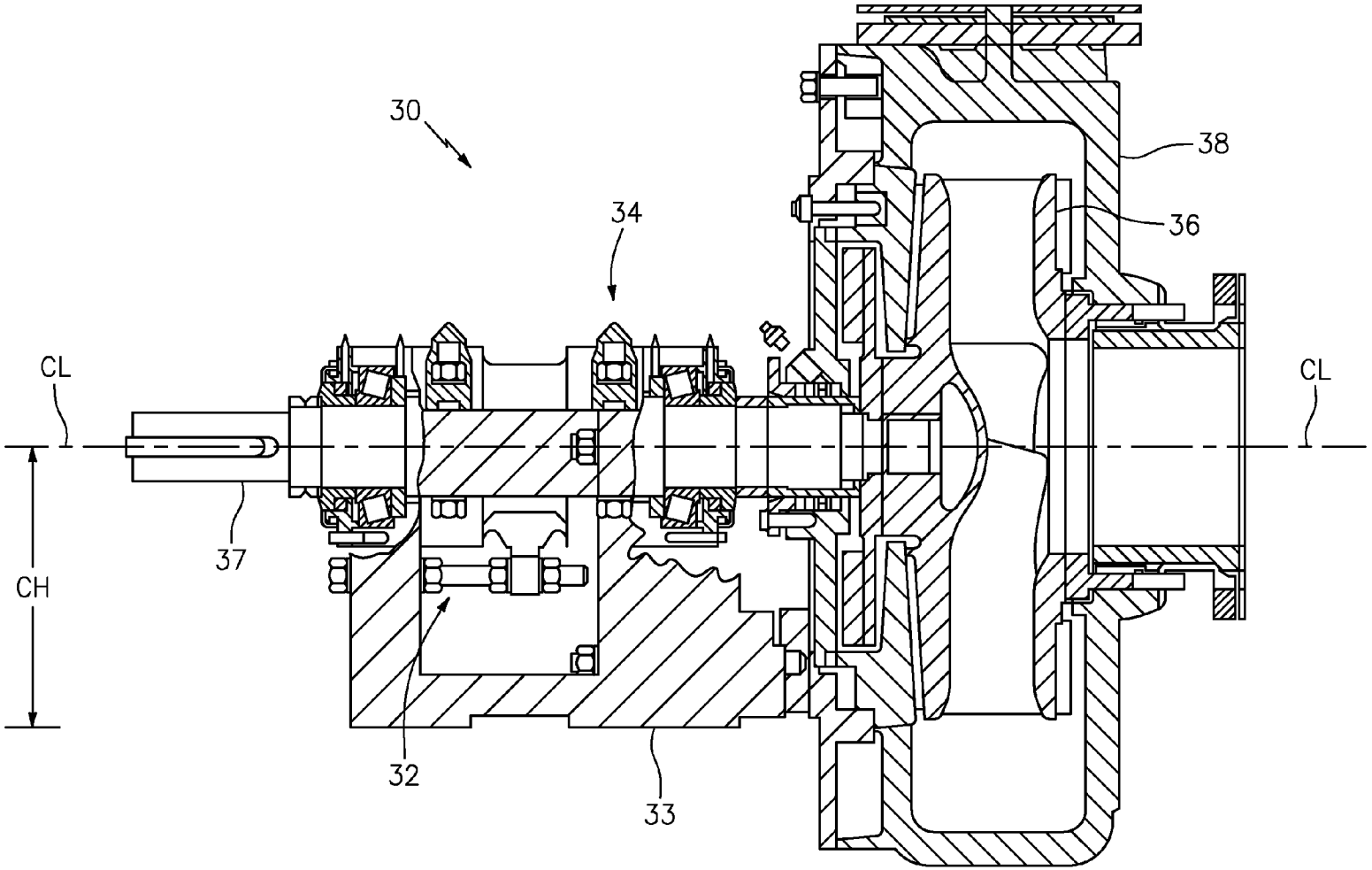
FIG. 1*c* shows a side cross-sectional view of still another pump that is known in the art.
Figure 2:
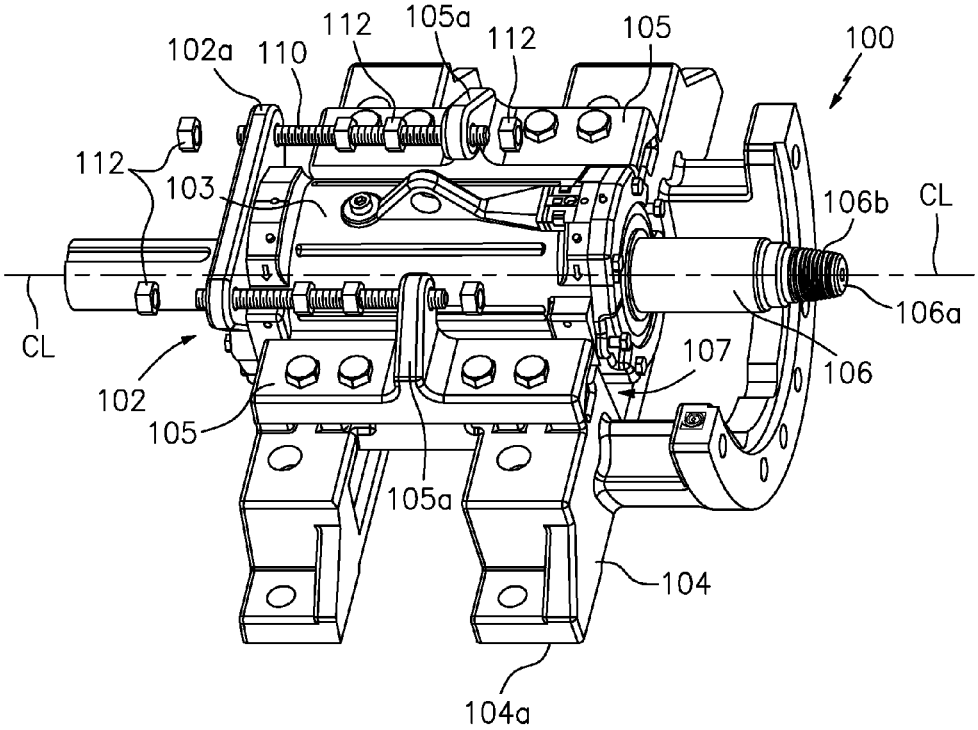
FIG. 2 shows a top perspective view of a powerframe having a shaft with tapered threads according to some embodiments of the present invention.
Figure 3:
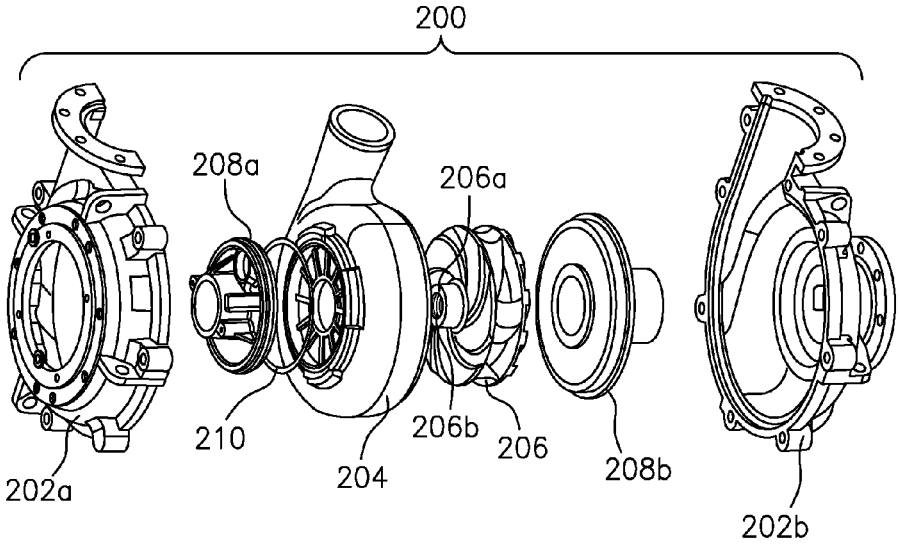
FIG. 3 shows an exploded view of a pumping arrangement having an impeller with corresponding tapered impeller threads according to some embodiments of the present invention.

FIGS. 2 and 3

By way of example, the present invention is described in relation to the pump assembly, arrangement or combination shown in FIGS. 2-3, although the scope of the invention is intended to include apparatus, such as other types or kinds of rotary equipment, assemblies, arrangements, devices or combinations having a rotating shaft coupled directly to an impeller, that are either now known or later developed in the future. For example, FIGS. 2-3 show the pump assembly, arrangement or combination, where FIG. 2 shows the pump or pumping assembly, arrangement or combination generally indicated as 100 having a power frame 102, a bearing cartridge 103, a pedestal 104 and a power transmission shaft 106; and where FIG. 3 shows a pumping assembly combination generally indicated as 200 having outer casing sub-components 202*a* and 202*b*, a pump or volute liner 204, an impeller 206, front and rear liners and/or covers 208*a*, 208*b* and a gasket 210. The pedestal 104 is configured with an axial channel generally indicated by arrow 107 to receive and support the bearing cartridge 103 and allow the bearing cartridge 103 to slide therein. The power transmission shaft 106 has an end 106*a* with tapered threads 106*b*. The impeller 206 has a bore 206*a* having corresponding threads 206*b*. By way of example, when the bearing cartridge is coupled or assembled to the pumping assembly combination 200, the power transmission shaft 106 may be coupled directly to the impeller 206 so that the tapered threads 106*b* of the power transmission shaft 106 rotationally mate and frictionally engage the corresponding tapered threads 206*b* of the impeller 206, although the scope of the invention is intended to include other types or kind of couplings either now known or later developed in the future. Other parts of the apparatus or combination 100 (FIG. 2) and the pumping assembly combination 200 are also mated together, which do not form part of the underlying invention and are not described in detail.

In FIG. 2, the power frame 102 has an end cover 102*a* having bores and turns (unlabeled). The pedestal 104 also has hold down plates 105 having wings 105*a* with holes that penetrate to allow threaded bolts or rods 110 to pass through. A bearing cartridge 103 may be mounted in the pedestal 104 on wings (not shown) that mate with machined grooves or ways (not shown) in the pedestal 104. The apparatus or combination 100 also includes an adjustable mounting assembly configured with threaded bolts or rods 110 arranged in holes of the end cover 102*a* and the corresponding holes in the wings 105*a*. The adjustable mounting assembly also includes nuts 112 for adapting on the threaded bolts or rods 110, which may be loosened and tightened in a manner that would be appreciated by one skilled in the art without undue experimentation in order to move, slide or adjust the power frame 102 and bearing cartridge 103 in relation to the pedestal 104, and further in relation to the pumping assembly combination 200. The hold-down plates 105 are configured to clamp the bearing cartridge 103 in the pedestal 104 to prevent its movement after it has been appropriately adjusted, and are also configured with grooves machined therein (not shown). Appropriate pairs of nuts 112 are suitably tightened on both sides of the end plate 102*a* and the wings 105*a* in order to secure the bearing cartridge 103 in relation to pedestal 104 and the pumping assembly combination 200.

The bearing cartridge 103 has a predetermined centerline that is indicated, by way of example, as reference label CL. For the purpose of describing some embodiments of the present invention, in FIG. 2 the centerline is shown about or approximately in line with the axis of the power frame shaft 106, although the scope of the invention is not intended to be limited to how the centerline CL is predetermined. For example, embodiments of the invention are envisioned in which the centerline is predetermined to be above or below the axis of the power frame shaft 106 within the spirit of the present invention.

The pedestal 104 has a bottom surface 104*a*. According to some embodiments of the present invention, the bearing cartridge 103 and the pedestal 104 are configured to couple together above the centerline CL of the bearing cartridge 103 in order to reduce center height requirements of the apparatus 100, where the center height CH is defined as the distance between the centerline CL of the bearing cartridge 103 and the bottom surface 104*a* of the pedestal 104 supporting the bearing cartridge 103. By way of example, the centerheight CH is marked and shown in FIG. 4.

According to the present invention, the bearing cartridge 103 and the pedestal 104 are configured to couple together substantially at or above the centerline CL of the bearing cartridge 103 in order to reduce center height requirements of the apparatus 100. According to the present invention, the phrase "substantially at" is intended to include embodiments or implementations where the bearing cartridge 103 and the pedestal 104 are coupled together at or near the centerline of the bearing cartridge 103, and the term "above" is intended to include embodiments or implementations where the bearing cartridge 103 and the pedestal 104 are coupled together over or higher than the centerline CL of the bearing cartridge 103.

The other parts of the pumping assembly combination 200 shown in FIG. 3, including the outer casing sub-components 202*a* and 202*b*, the pump or volute liner 204, the front and reap liners and/or covers 208*a*, 208*b* and the gasket 210 do not form part of the underlying invention, are known in the art, and are not described in detail herein. Embodiments are also envisioned in which a doubled casing design may be used, e.g., such that expensive hard metal parts are contained within an outer casing of ductile iron.

Moreover, the bearing cartridge 103 may also be configured to be coupled to a shaft or a motor (not shown). This coupling does not form part of the underlying invention, especially in relation to the features of the apparatus 100, and thus is not shown or described in detail. In view of this, the scope of the invention is not intended to be limited to the way the bearing cartridge 103 and motor are coupled together. For example, the bearing cartridge 103 may be coupled to the motor by various means or techniques within the scope and spirit of the present invention, including being directly coupled, being coupled through belt drives, as well as being coupled through some other intermediate equipment or apparatus either now known or later developed in the future.

FIG. 4

Figure 4:
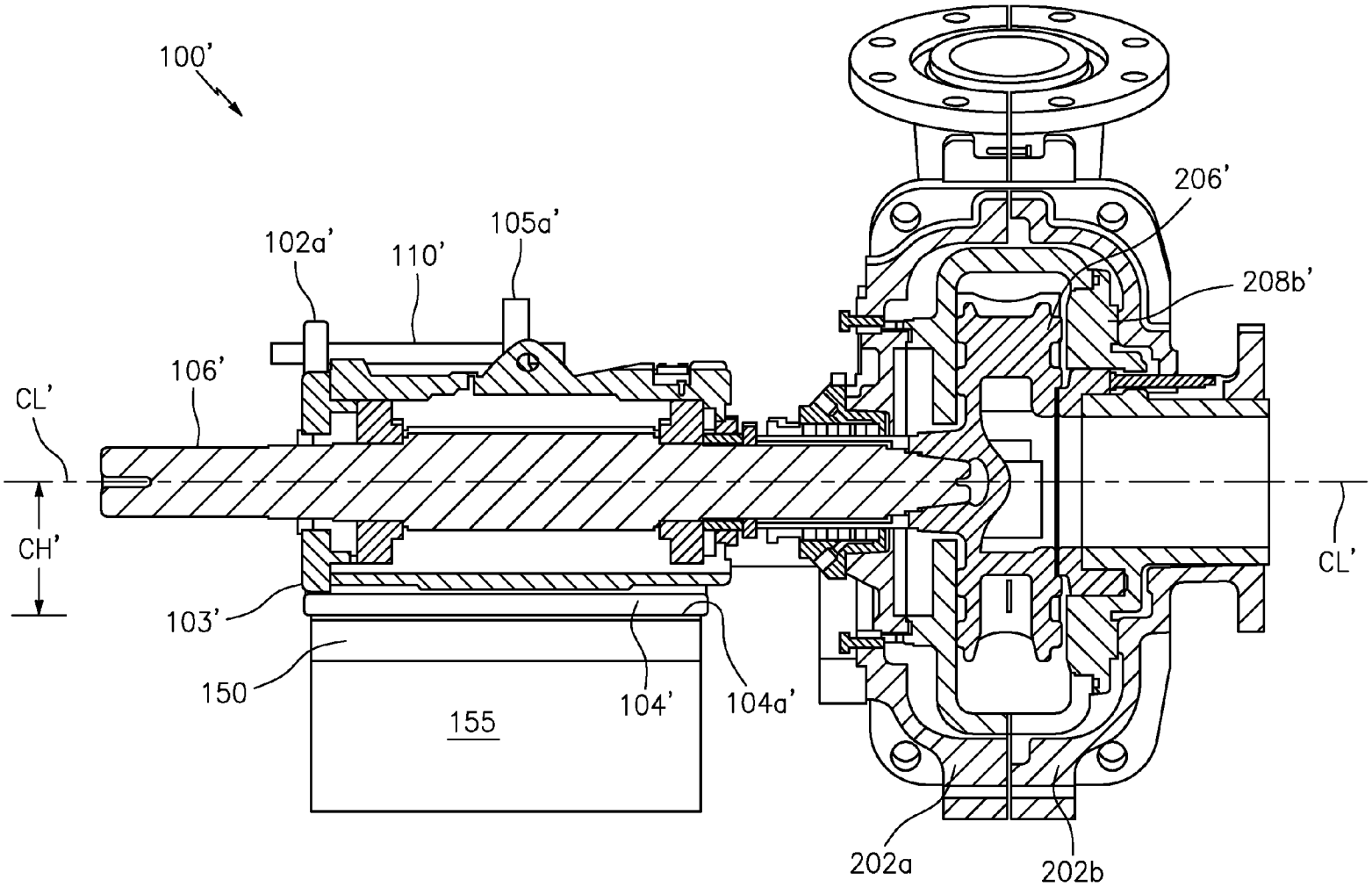
FIG. 4 shows a cross-section view of a pump or pumping assembly, arrangement or combination according to some embodiments of the present invention.

FIG. 4 shows apparatus 100' according to some embodiments of the present invention, which places the mounting arrangement, including adjusting threaded bolts or rods above the centerline CL of the bearing cartridge 103' to reduce center height requirements. Similar parts in FIGS. 2-3 are numbered with similar reference numerals in FIG. 4 with the addition of a single quote mark ("').

In FIG. 4, the apparatus 100' may also include a base adapter 150 configured to be arranged between the pedestal 104' and a pre-existing supporting foundation indicated with reference label 155 and also configured to support the pedestal 104' on the pre-existing supporting foundation 155. Base adapters are known in the art, and the scope of the present invention is not intended to be limited to any particular type or kind thereof, and may include base adapter configuration both now known and later developed in the future.

FIG. 5

Figure 5:
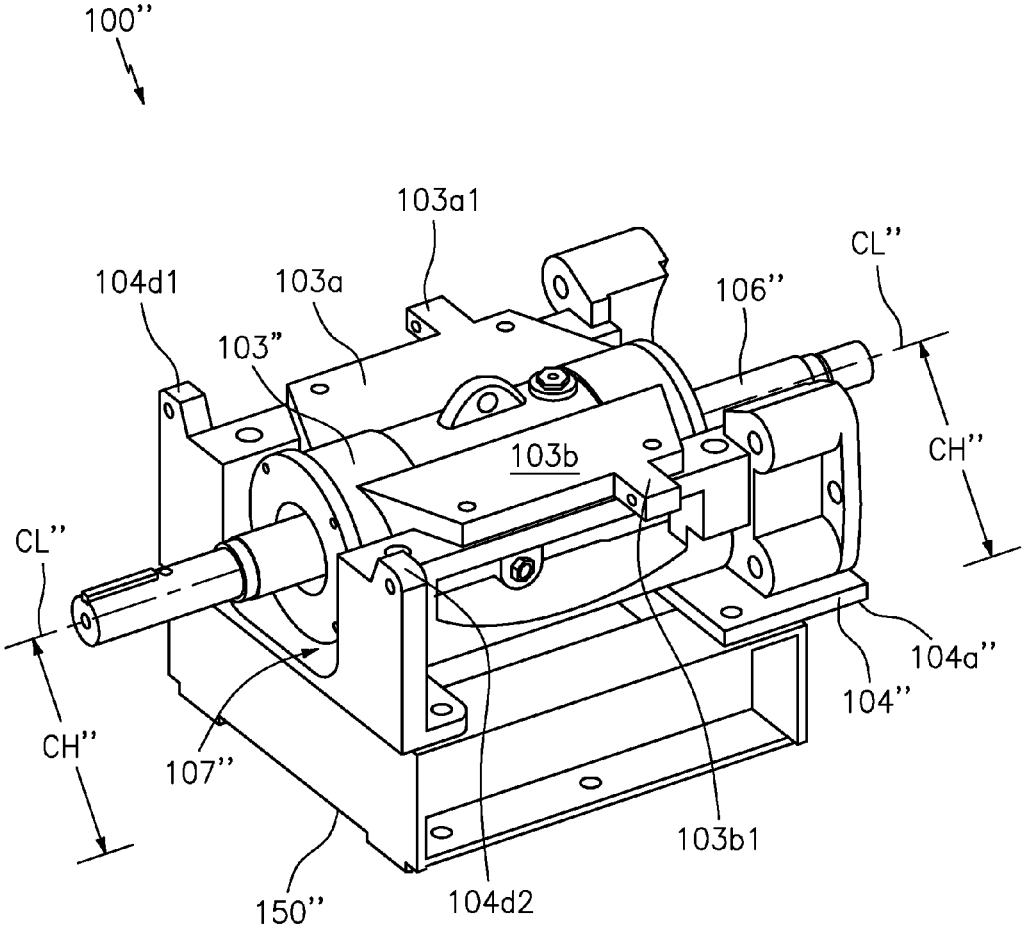
FIG. 5 is a diagram of a pump or pumping assembly, arrangement or combination according to some embodiments of the present invention.

FIG. 5 shows apparatus 100' according to some embodiments of the present invention. In FIG. 5, the mounting arrangement is not shown. Similar parts in FIGS. 2-4 are numbered with similar reference numerals in FIG. 5 with the addition of a double quote mark ("'"). The centerline CL" and center height CH" are indicated and determined consistent with that set forth above, which is an indication of the distance from the axis of the shaft 106" and the bottom surface 104*a*" of the pedestal 104". In this embodiment, the bearing cartridge 103" is configured with wings 103*a* and 103*b* extending laterally from an upper surface of the bearing cartridge as shown. Each wing 103*a* and 103*b* has a mounting member 103*a*1 and 103*b*1 having a respective hole configured therein for receiving a threaded bolt or rod (not shown in FIG. 5) and for coupling to a corresponding mounting member 104*d*1 and 104*d*2 of the pedestal 104", consistent with that set forth herein. This embodiment is shown as another example of an implementation of the present invention, and the scope of the invention is intended to include other implementations within the spirit of the present invention.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What we claim is:

1. Apparatus designed for an installation conversion, comprising:

a power frame having an end cover configured with a bore/hole and turns;

a bearing cartridge configured to be coupled to a power transmission shaft that goes or extends through the end cover of the power frame, also configured to be coupled to a pumping assembly combination, and having a predetermined centerline;

a pedestal configured with an axial channel to receive, support and allow the bearing cartridge to slide axially therein in relation to the predetermined centerline, the pedestal comprising at least one hold down plate having a wing with a corresponding bore/hole; and an adjustable mounting assembly configured to couple together the bearing cartridge and the pedestal substantially at or above the predetermined centerline of the bearing cartridge in order to reduce center height requirements of the pumping assembly combination, the adjustable mounting assembly comprising a threaded bolt/rod arranged in the hole/bore of the end cover and the corresponding hole/bore of the wing of the at least one hold down plate, and the adjustable mounting assembly comprising nuts for adapting on the threaded bolt/rod that may be loosened and tightened in order to move, slide or adjust the power frame and bearing cartridge in either axial direction in relation to the pedestal, and further in relation to the pumping assembly combination.

2. Apparatus according to claim 1, wherein the center height is defined as the distance between the predetermined centerline of the bearing cartridge and the bottom surface of the pedestal supporting the bearing cartridge.

3. Apparatus according to claim 1, wherein the end cover is configured with two bores/holes;

the pedestal comprises two hold down plates, each having a respective wing configured with a respective bore/hole; and the adjustable mounting assembly comprises two threaded bolts/rods, each threaded bolt/rod arranged in a respective hole/bore of the end cover and a corresponding respective hole/bore of the respective wing of the two hold down plates.

4. Apparatus according to claim 1, wherein the pumping assembly combination comprises outer casing sub-components, a pump or volute liner, an impeller and front and rear liners or covers.

5. Apparatus according to claim 1, wherein the bore/hole is configured to allow the threaded bolt/rod to pass through.

6. Apparatus according to claim 1, wherein the at least one hold down plate is configured to clamp the bearing cartridge in the pedestal to prevent movement thereof after the bearing cartridge has been axially adjusted.

7. Apparatus according to claim 1, wherein the apparatus comprises a slurry-type pump or a centrifugal pump.

8. Apparatus according to claim 1, wherein the apparatus comprises a base adapter configured to be arranged between the pedestal and a pre-existing supporting foundation so as to support the pedestal on the pre-existing supporting foundation.

9. Apparatus according to claim 1, wherein the nuts are tightened on both sides of the end cover and the wing in order to secure the bearing cartridge in relation to the pedestal and the pumping assembly combination.

10. Apparatus according to claim 1, wherein the power frame has the shaft with an axis, and the predetermined centerline is about or approximately in line with the axis of the shaft of the power frame.

11. Apparatus according to claim 10, wherein the bore/hole is configured in the end cover, and the corresponding bore/hole is configured in the wing, so as to be above the predetermined centerline.

12. Apparatus designed for an installation conversion, comprising:

a power frame having an end cover configured with a bore/hole and turns;

a bearing cartridge configured to be coupled to a pumping assembly combination and having a predetermined centerline, the bearing cartridge comprising a wing extending from an upper surface thereof above the centerline, the wing being configured with a corresponding bore/hole;

a pedestal configured with an axial channel to receive, support and allow the bearing cartridge to slide axially therein in relation to the predetermined centerline; and an adjustable mounting assembly configured to couple together the bearing cartridge and the pedestal substantially at or above the predetermined centerline of the bearing cartridge in order to reduce center height requirements of the pumping assembly combination, the adjustable mounting assembly comprising a threaded bolt/rod arranged in the hole/bore of the end cover and the corresponding hole/bore of the wing of the bearing cartridge, and the adjustable mounting assembly comprising nuts for adapting on the threaded bolt/rod that may be loosened and tightened in order to move, slide or adjust the power frame and bearing cartridge in either axial direction in relation to the pedestal, and further in relation to the pumping assembly combination.

13. Apparatus according to claim 12, wherein the center height is defined as the distance between the predetermined centerline of the bearing cartridge and the bottom surface of the pedestal supporting the bearing cartridge.

14. Apparatus according to claim 12, wherein the end cover is configured with two bores/holes;

the bearing cartridge comprises two wings, each wing configured with a respective bore/hole; and the adjustable mounting assembly comprises two threaded bolts/rods, each threaded bolt/rod arranged in a respective hole/bore of the end cover and a corresponding respective hole/bore of a respective wing.

15. Apparatus according to claim 12, wherein the apparatus comprises a base adapter configured to be arranged between the pedestal and a pre-existing supporting foundation so as to support the pedestal on the pre-existing supporting foundation.

16. Apparatus according to claim 12, wherein the power frame has a shaft with an axis, and the predetermined centerline is about or approximately in line with the axis of the shaft of the power frame.

17. Apparatus designed for an installation conversion, comprising:

a power frame having an end cover configured with a bore/hole and turns;

a bearing cartridge configured to be coupled to a pumping assembly combination and having a predetermined centerline, the bearing cartridge comprising a wing extending from an upper surface thereof above the predetermined centerline, the wing configured with a corresponding bore/hole, the wing being connected to, or forming part of, the bearing cartridge;

a pedestal configured with an axial channel to receive, support and allow the bearing cartridge to slide axially therein in relation to the predetermined centerline; and an adjustable mounting assembly configured to couple together the bearing cartridge and the pedestal substantially at or above the predetermined centerline of the bearing cartridge in order to reduce center height requirements of the pumping assembly or combination, the adjustable mounting assembly comprising a threaded bolt/rod arranged in the hole/bore of the end cover and the corresponding hole/bore of the wing of the bearing cartridge, and the adjustable mounting assembly comprising nuts for adapting on the threaded bolt/rod that may be loosened and tightened in order to move, slide or adjust the power frame and bearing cartridge in either axial direction in relation to the pedestal, and further in relation to the pumping assembly combination.

18. Apparatus according to claim 17, wherein the pumping assembly combination comprises outer casing sub-components, a pump or volute liner, an impeller and front and rear liners or covers.

19. Apparatus according to claim 17, wherein the power frame has a shaft with an axis, and the predetermined centerline is about or approximately in line with the axis of the shaft of the power frame.

* * * * *